US007417657B2

(12) United States Patent
Im et al.

(10) Patent No.: US 7,417,657 B2
(45) Date of Patent: Aug. 26, 2008

(54) THERMAL PRINTER AND PRINTING METHOD

(75) Inventors: Dac-hycok Im, Suwon-si (KR); Kyung-pyo Kang, Suwon-si (KR); Hyoung-il Kim, Suwon-si (KR); Myung-bo Son, Anyang-si (KR); Dong-hun Han, Suwon-si (KR); Yong-duk Lee, Gunpo-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 385 days.

(21) Appl. No.: 11/172,820

(22) Filed: Jul. 5, 2005

(65) Prior Publication Data

US 2006/0012663 A1 Jan. 19, 2006

(30) Foreign Application Priority Data

Jul. 19, 2004 (KR) ..... 10-2004-0055944

(51) Int. Cl.
*B41J 11/00* (2006.01)

(52) U.S. Cl. ..... 347/218

(58) Field of Classification Search ..... 347/218, 347/104; 400/188, 582, 583, 578, 615.2, 400/707

See application file for complete search history.

(56) References Cited

U.S. PATENT DOCUMENTS

| | | | |
|---|---|---|---|
| 4,523,869 | A | 6/1985 | Martin |
| 5,564,845 | A | 10/1996 | Yamaguchi et al. |
| 6,011,574 | A | 1/2000 | Tazaki et al. |
| 6,015,241 | A | 1/2000 | Wiklof et al. |
| 6,168,333 | B1 | 1/2001 | Merz et al. |
| 6,601,952 | B2 | 8/2003 | Sugioka et al. |
| 2002/0001027 | A1 | 1/2002 | Sugioka et al. |

FOREIGN PATENT DOCUMENTS

| | | |
|---|---|---|
| EP | 0 504 878 A2 | 9/1992 |
| JP | 61-237561 | 10/1986 |
| JP | 9-118056 | 5/1997 |
| JP | 9-156144 | 6/1997 |
| JP | 10-045278 | 2/1998 |
| JP | 2003-252491 | 9/2003 |

*Primary Examiner*—K. Feggins
(74) *Attorney, Agent, or Firm*—Roylance, Abrams, Berdo & Goodman, L.L.P.

(57) ABSTRACT

A thermal printer and a printing method are provided. The thermal printer includes a thermal printhead for applying a predetermined amount of heat to a thermal recording paper to develop a print layer provided on the thermal recording paper; a feeding roller for feeding the thermal recording paper, a platen roller for facing the thermal printhead to support the thermal recording paper, wherein the thermal recording paper passes between the thermal printhead and the platen roller, a first encoder sensor for detecting a rotation of the platen roller, a second encoder sensor for detecting rotation of the feeding roller; a counting unit for counting first and second pulse signals generated from the first and second encoder sensors, respectively, and a switching unit of the first and second pulse signals as a variable to control the feeding of the thermal recording paper.

12 Claims, 6 Drawing Sheets

THERMAL PRINTER AND PRINTING METHOD

CROSS-REFERENCE TO RELATED APPLICATION

This application claims the benefit under 35 U.S.C. §119 (a) of Korean Patent Application No. 10-2004-0055944, filed on Jul. 19, 2004, in the Korean Intellectual Property Office, the entire disclosure of which is hereby incorporated by reference.

BACKGROUND OF THE INVENTION

1. Field of the Invention

The present invention relates to a thermal printer and printing method. More specifically, the present invention relates to a thermal printer and printing method capable of printing a thermal recording paper with compensation of slip thereof.

2. Description of Related Art

Thermal printers use a special type of paper, (hereinafter, referred to as "thermal recording paper") which reacts to the application of heat to display a predetermined color, and ink ribbons, which react to the application of heat to transfer a predetermined color to a regular sheet of paper to print thereon. In the case where ink ribbons are used, a driving device is required, so that the construction of the printer is more complicated and the cost is higher. In addition, the ink ribbons need to be replaced regularly. Thus, a printing cost per sheet of paper is high.

Referring to FIG. 1, a thermal recording paper 10 includes a base sheet 11, and predetermined colors of ink layers provided at both surfaces, such as the first and second surfaces 10*a* and 10*b* of the base sheet 11. The ink layers are typically layers of different colors. For example, yellow Y and magenta M layers are provided on the first surface 10*a* one after another, while a cyan C layer is provided on the second surface 10*b*. Preferably, the base sheet 11 is a transparent material. Reference number 13 indicates a transparent layer or a reflective layer. An example of the thermal recording paper 10 is described in U.S. Pat. No. 6,801,233.

In a conventional thermal printer that uses the thermal recording paper 10, a thermal printhead (TPH), which is used to generate the image on the thermal recording paper 10, has thermal transfer elements that are arranged at a predetermined resolution in a direction perpendicular to a feeding direction of the thermal recording paper.

FIG. 2 is a diagram of a conventional thermal printer.

The thermal printer includes a feed roller 2 for feeding the thermal recording paper 10, a platen 3 for supporting one surface of the thermal recording paper 10, and a TPH 4 for forming an image over the thermal recording paper 10 supported by the platen 3. An idle roller 5 causes the thermal recording paper 10 to pass between the idle roller 5 and the feeding roller 2 to be closely adhered to the feeding roller 2.

Further, in the thermal printer, a paper fed by a thermal or mechanical load may slip. In particular, the amount of slip may be different for each side or surface of the thermal recording paper, so that image misalignment between each surface may occur, which will degrade image quality.

SUMMARY OF THE INVENTION

Embodiments of the present invention provide a thermal printer and a printing method for aligning and printing images irrespective of the slip of the thermal recording paper.

According to an aspect of the present invention, there is provided a thermal printer comprising a thermal printhead for applying a predetermined amount of heat to a thermal recording paper to develop a print layer provided on the thermal recording paper; a feeding roller for feeding the thermal recording paper; a platen roller for facing the thermal printhead to support the thermal recording paper, wherein the thermal recording paper passes between the thermal printhead and the platen roller; a first encoder sensor for detecting a rotation of the platen roller; a second encoder sensor for detecting a rotation of the feeding roller; a counting unit for counting first and second pulse signals generated from the first and second encoder sensors, respectively; and a switching unit for selecting one of the first and second pulse signals as a variable to control feeding of the thermal recording paper.

In the case where an image is printed on the thermal recording paper, the switching unit may select the first pulse signal to use as a control signal to feed the thermal recording paper and a control signal to drive the thermal printhead, and in a case where an image is not printed on the thermal recording paper, the switching unit may select the second pulse signal to use as the control signal to feed the thermal recording paper.

When an accumulated count of the first pulse signal reaches a predetermined number, the counting unit may generate a signal to fire the thermal printhead and output the signal to fire the thermal printhead.

According to another aspect of the present invention, there is provided a thermal printing method with slip compensation comprising a first step of feeding a thermal recording paper into a print path by using a second encoder sensor attached to a feeding roller; a second step of printing on a first surface of the thermal recording paper while measuring a feeding distance of the thermal recording paper by using a first encoder sensor attached to a platen roller; a third step of rotating a thermal printhead to face a second surface of the thermal recording paper; a fourth step of feeding the thermal recording paper to the print path by using a second encoder sensor; and a fifth step of printing on a second surface of the thermal recording paper while measuring the feeding distance of the thermal recording paper by using the first encoder sensor.

The second and fifth steps may include a step of generating a signal to fire the thermal printhead when an accumulated count of the first pulse signal reaches a predetermined number.

The first and fourth steps may include a step of controlling a feeding distance of the thermal recording paper while measuring the feeding distance of the thermal recording paper by using a second pulse signal from the second encoder sensor.

According to yet another aspect of the present invention, there is provided a line-feeding printer comprising a printhead for printing a predetermined color on a paper; a feeding roller for feeding the paper; a platen roller for facing the printhead to support the paper, wherein the paper passes between the printhead and the platen roller; a first encoder sensor for detecting a rotation of the platen roller; a second encoder sensor for detecting a rotation of the feeding roller; a counting unit for counting first and second pulse signals generated from the first and second encoder sensors, respectively; and a switching unit for selecting one of the first and second pulse signals as a variable to control feeding of the paper.

According to still another aspect of the present invention, there is provided a line-feeding printing method comprising a first step of picking up a print paper and feeding the print paper into a print path; and a second step of printing on a first surface of the print paper while measuring a feeding distance of the print paper in the print path by using a first encoder sensor attached to a platen roller.

The line-feeding printing method may further comprise a third step of rotating a printhead to face a second surface of the print paper; a fourth step of feeding the print paper to the print path; and a fifth step of printing the second surface of the print paper while measuring the feeding distance of the print paper by using the first encoder sensor.

BRIEF DESCRIPTION OF THE DRAWINGS

The above and other features and advantages of the present invention will become more apparent by describing in detail exemplary embodiments thereof with reference to the attached drawings in which.

It should be understood that throughout the drawings like reference numbers refer to like features, structures and elements.

DETAILED DESCRIPTION OF EXEMPLARY EMBODIMENTS

Now, a thermal printer and printing method according to an embodiment of the present invention that will be described with reference to the attached drawings.

Figure 1:
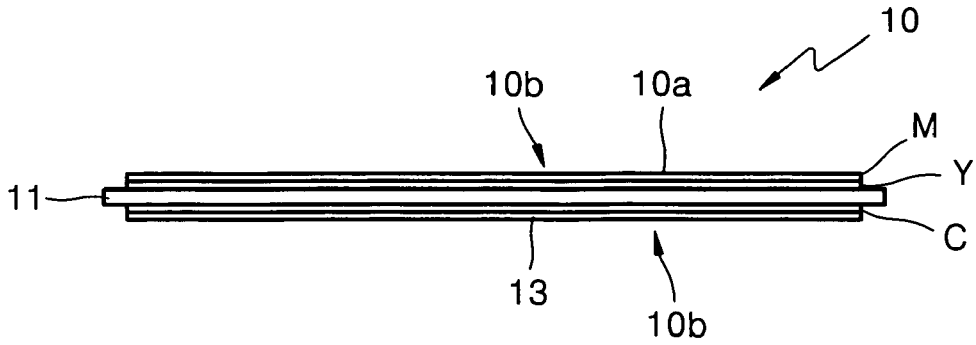
FIG. 1 (PRIOR ART)
FIG. 1 is a cross sectional view of a conventional sheet of thermal recording paper.
Figure 2:
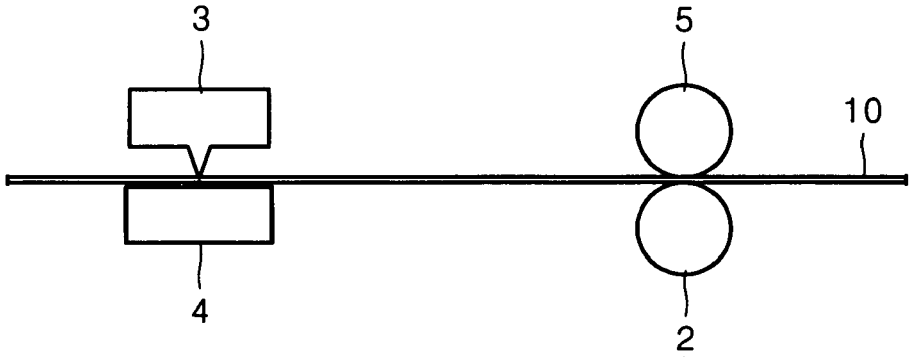
FIG. 2 (PRIOR ART)
FIG. 2 is a diagram of a conventional thermal printer.
Figure 3:
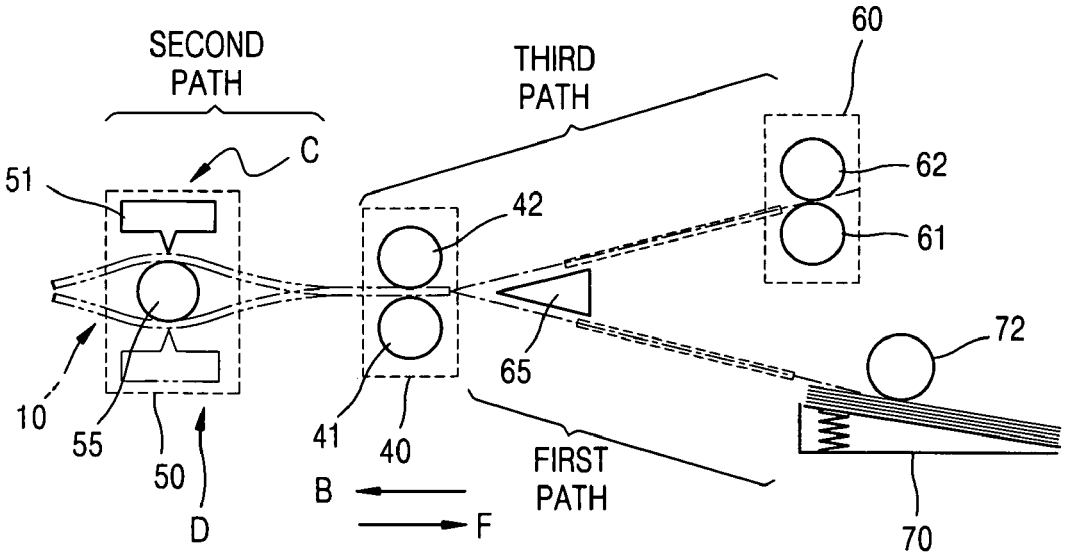
FIG. 3 is a diagram of a thermal printer for explaining the printing method for the thermal printer according to an embodiment of the present invention.

FIG. 3 is a diagram of a thermal printer for explaining the printing method of the thermal printer according to an embodiment of the present invention.

The thermal printer has at least three paths, such as first, second, and third paths, through which a sheet of thermal recording paper 10 is moved. The first path is a paper supply path for moving the thermal recording paper 10 to the second path. The second path is a path along which the thermal recording paper 10 is fed backward for a preparation of printing in the direction of arrow B and is fed forward for printing in the direction of arrow F. In addition, the third path is a path at which the thermal recording paper 10 is placed during the printing operation on the first surface of the thermal recording paper 10. After the thermal recording paper 10 is printed on the first surface, it is returned to the second path and the thermal recording paper 10 after being printed on both the first and second surfaces is finally discharged along the third path.

A paper guide 65 is arranged between the first and third paths. The paper guide 65 guides the thermal recording paper 10 to move from the first path to the second path and from the second path to the third path. In addition, the paper guide 65 guides the thermal recording paper 10 to move from the second path to the third path rather than the first path, and guides the thermal recording paper 10 from the first path only to the second path. Since the construction of the paper guide 65 is well known, its design and understanding thereof will not be explained any further.

In the second path, an image forming unit 50 performs image formation. The image formation can be performed by two, and if necessary, or more times of image forming processes. However, in the present embodiment, the image formation is performed twice in total, one time for each of the first and second surfaces. Before images are formed on the first and second surfaces of the thermal recording paper 10, the respective positions of a thermal printhead (TPH) 51 and a platen roller 55 of the image forming unit 50 should be predetermined. In other words, when the image formation is performed on the first surface of the thermal recording paper 10, the TPH 51 should be arranged at the C region, and while the image formation is performed on the second surface of the thermal recording paper 10, the TPH 51 should be arranged at the D region. Preferably, the position of the TPH 51 changes such that the platen roller 55 and the TPH 51 are rotated with reference to a center of a rotational axis of the platen roller 55. The position of the TPH 51 changes when the thermal recording paper 10 does not obstruct the TPH's 51 movement. For example, the TPH 51 in not obstructed when the paper is not supplied to the second path from the first path or when the thermal recording paper 10 is not returned to the second path from the first path or when the thermal recording paper 10 is not returned to the second path after the thermal recording paper 10 is moved to the third path during image formation on the first surface.

When the thermal recording paper 10 in which the image is already formed on the first surface is fed backward into the second path, the position-changed TPH 51 forms an image on the second surface. During the process, the thermal recording paper 10 gradually moves by the conveying unit 40. After the image formation on the second surface is completed, the thermal recording paper 10 further moves along the second path, and is discharged through a paper discharge unit 60. The conveying unit 40 includes a feeding roller 41 feeding the thermal recording paper 10, and an idle roller 42 pushing the thermal recording paper 10 entering between the idle roller 42 and the feeding roller 41 toward the feeding roller 41.

Reference numeral 70 indicates a paper storage unit and reference numeral 72 indicates a pick up roller supplying papers.

The paper discharge unit 60 includes a discharge roller 61 and an idle roller 62. The may be arranged as one roller that performs the functions of both the discharge roller 61 and the pick up roller 72.

Figure 4:
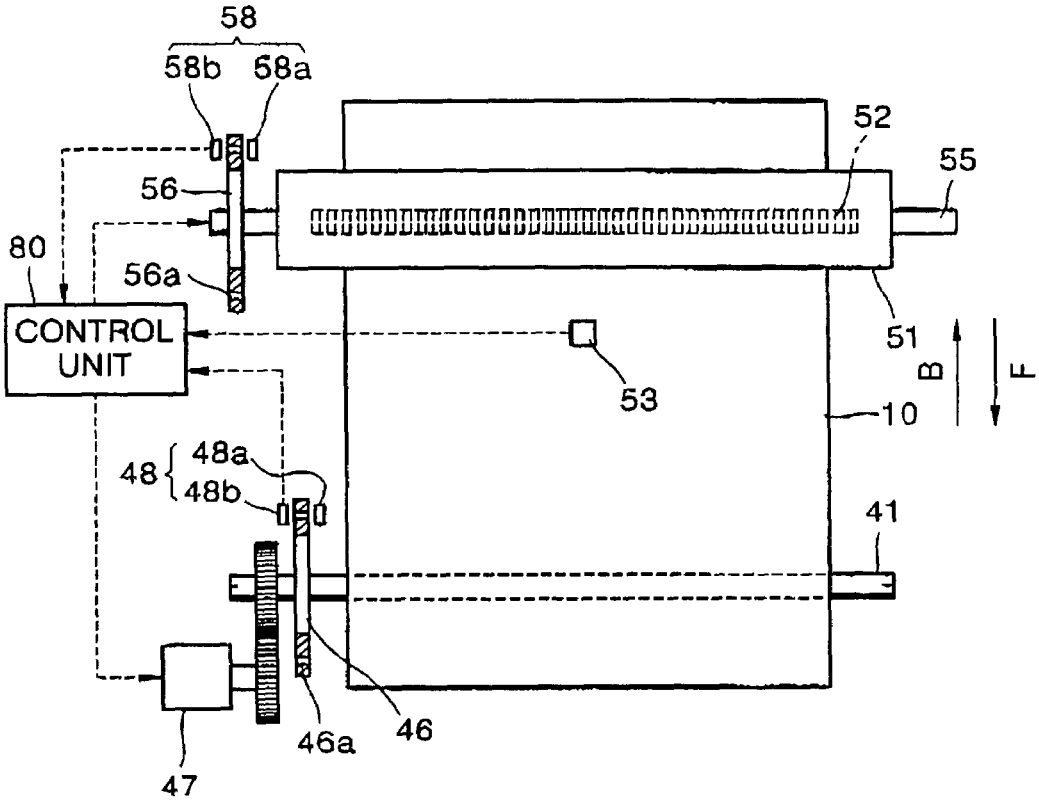
FIG. 4 is a schematic plan view showing a thermal printer according to an embodiment of the present invention.
Figure 5:
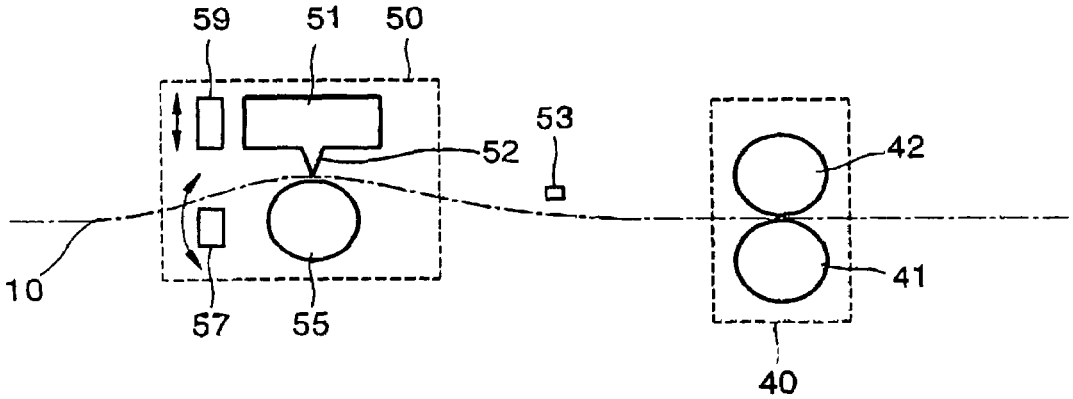
FIG. 5 is a schematic surface view of FIG. 4.

FIG. 4 is a schematic plan view showing a thermal printer according to an embodiment of the present invention, and FIG. 5 is a schematic surface view of FIG. 4.

The thermal recording paper 10 enters between the platen roller 55 and the TPH 51 is moved by driving the feeding roller 41.

The feeding roller 41 feeds the thermal recording paper in both the direction of arrow B, the back-feeding direction, and in the direction of arrow F, the print proceeding direction. Encoder disk wheels 56 and 46 are mounted on the circumference of one surface of the platen roller 55 and the feeding roller 41, respectively. Slits 56*a* and 46*a* are provided at the edges of the encoder disk wheels 56 and 46. First and second encoder sensors 58 and 48 including light-emitting units 58*a* and 48*a*, and light-receiving units 58*b* and 48*b*, respectively, are mounted on both surfaces of the slits 56*a* and 46*a*. The light-emitting units 58*a* and 48*a* of the encoder sensors 58 and 48 emit light at a certain rate, and the light-receiving units 58*b* and 48*b* generate pulse signals whenever the light-receiving units 58*b* and 48*b* receive light through the slits 56*a* and 46*a*. A control unit 80 measures the distance (referred to as the feeding distance) the thermal recording paper 10 is fed by the feeding roller 41 by counting the pulse signals, and controls the feeding distance the thermal recording paper 10 is fed by the feeding roller 41 by driving a driving motor 47. The control unit 80 outputs a signal to the heat transfer elements 52 of the TPH 51 when an accumulated count of the pulse signal from the first encoder sensor 58 reaches a predetermined number. Reference numeral 53 indicates a sensor for detecting the edge of the thermal recording paper 10. An optical sensor may be used herein to detect the edge of the thermal recording paper 10.

Further, the thermal printer preferably includes a rotating means 57 for rotating the TPH 51 and the platen roller 55 to print the second surface after the first surface of the thermal recording paper 10 for image formation is printed, and a vertical moving means 59 causing the TPH 51 to separate and ascend to a predetermined height from the print path. When the thermal recording paper 10 is fed backward, the TPH 51 is separated by a predetermined distance, for example, 1 to 2 mm from the platen roller 55 by using the vertical moving means 59 so that the thermal recording paper 10 may easily pass between the TPH 51 and the platen roller 55.

In an embodiment of the present invention, two encoder sensors 48 and 58 are used. At the time of back feeding the thermal recording paper 10, the second encoder sensor 48 attached to the feeding roller 41 is used to back feed the thermal recording paper 10 into an initial printing position. In addition, at the time of printing, the first encoder sensor 58 attached to the platen roller 55 is used to measure the actual feeding distance of the thermal recording paper 10 irrespective of the slip thereof.

Figure 6:
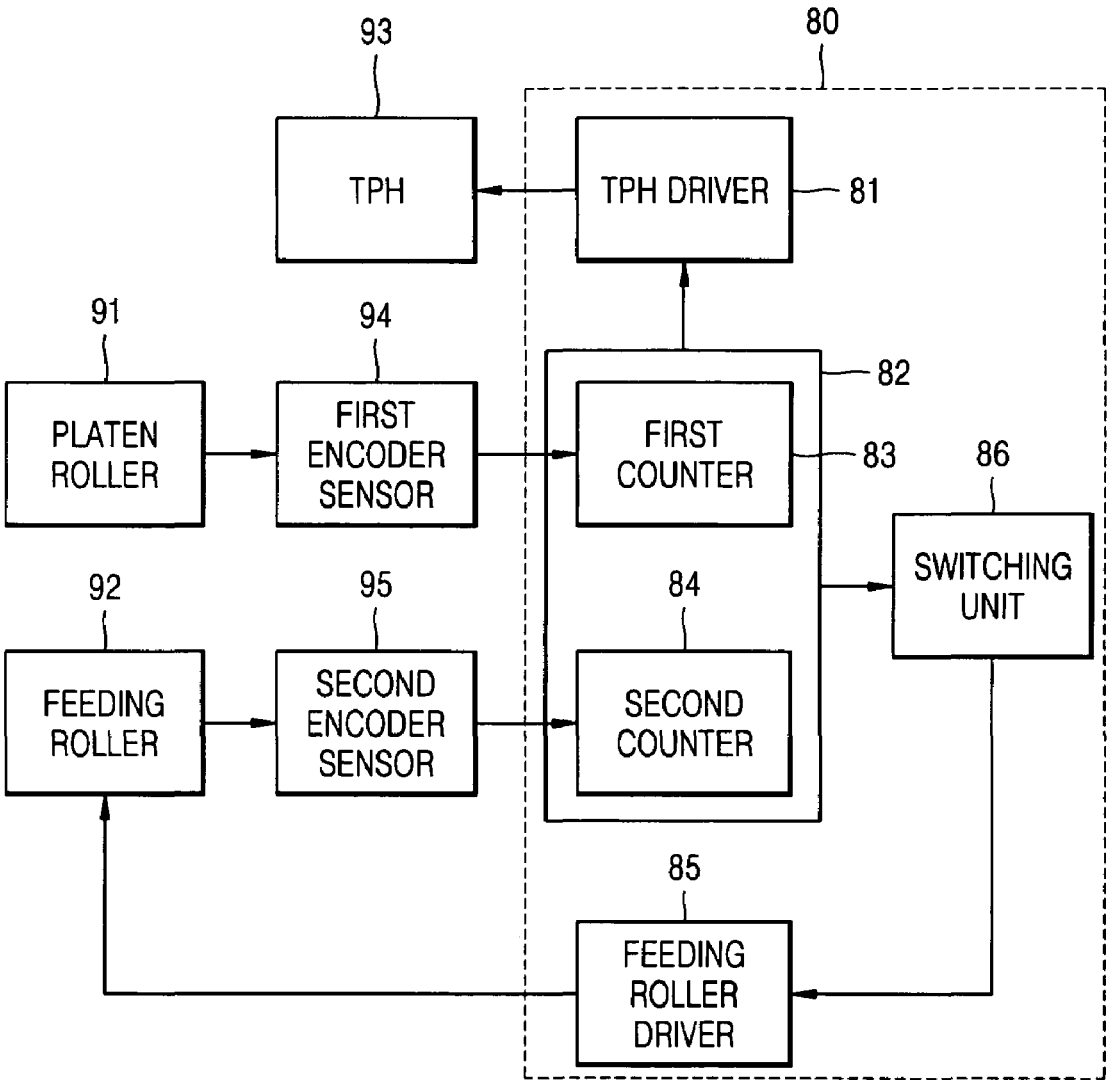
FIG. 6 is a block diagram for explaining the control of the thermal printer according to an embodiment of the present invention.

FIG. 6 is a block diagram for explaining the operation of the thermal printer according to an embodiment of the present invention;

The control unit 80 includes a TPH driver 81, a counting unit 82, a feeding roller driver 85, and a switching unit 86. A first encoder sensor 94 arranged on a platen roller 91 transmits to a first counter 83 first pulse signals generated by detecting the rotation of the platen roller 91. In addition, a second encoder sensor 95 arranged on a feeding roller 92 transmits to a second counter 84 second pulse signals generated by detecting the rotation of the feeding roller 92.

The switching unit 86 selects one of the first counter 83 and the second counter 84 of the counting unit 82 and drives the feeding roller driver 85 to control the feeding roller 92. Preferably, at the time of back feeding the thermal recording paper 10, the feeding roller 92 is controlled with reference to the second counter 84, and at the time of printing, the feeding roller 92 is controlled with reference to the first counter 83. In addition, during the printing process, when a count accumulated into the first counter 83 reaches a predetermined number, the TPH driver 81 is driven to generate a signal to control the TPH 93 so that a predetermined amount of heat is applied to the TPH 93. Therefore, the movement of the thermal recording paper 10 and the control of the TPH 93 are performed on the basis of the same signal. Thus, the movement of the thermal recording paper 10 and the control of the TPH 93 may be synchronized.

Now, a printing method for a thermal printer according to an embodiment of the present invention will be described in detail with reference to the drawings.

Figure 7:
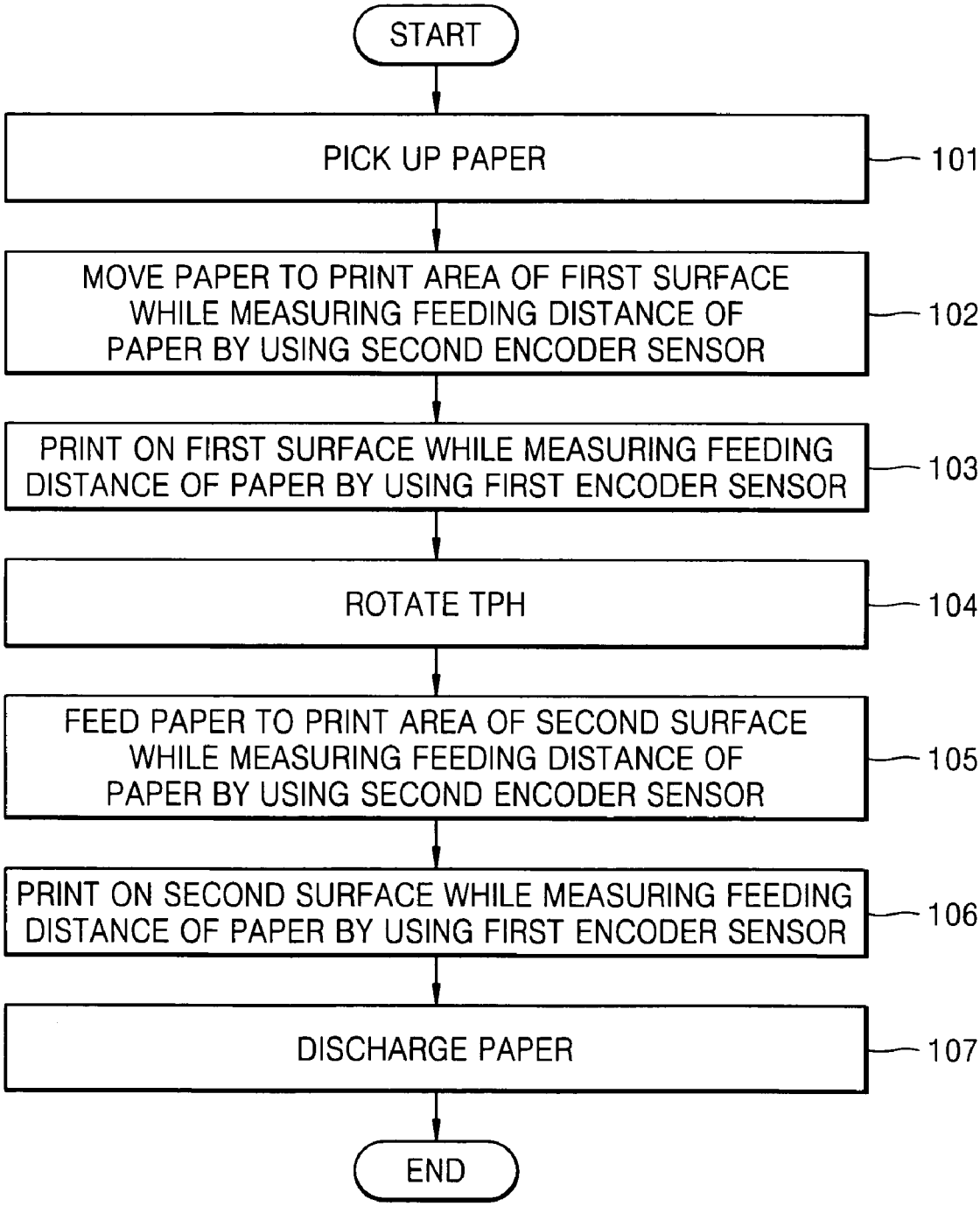
FIG. 7 is a flow chart of a printing method for the thermal printer according to an embodiment of the present invention.
Figure 8A:
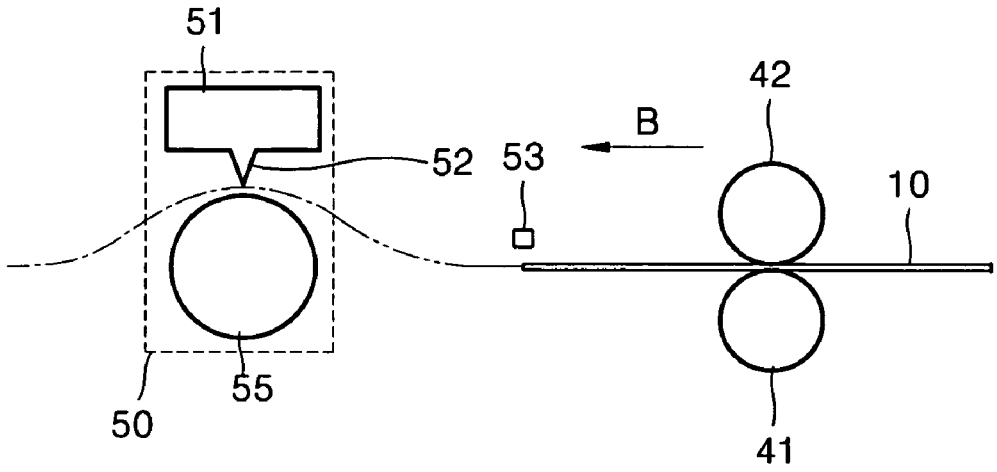
FIGS. 8A and 8B are diagrams for explaining a printing method of the thermal printer according to an embodiment of the present invention.
Figure 8B:
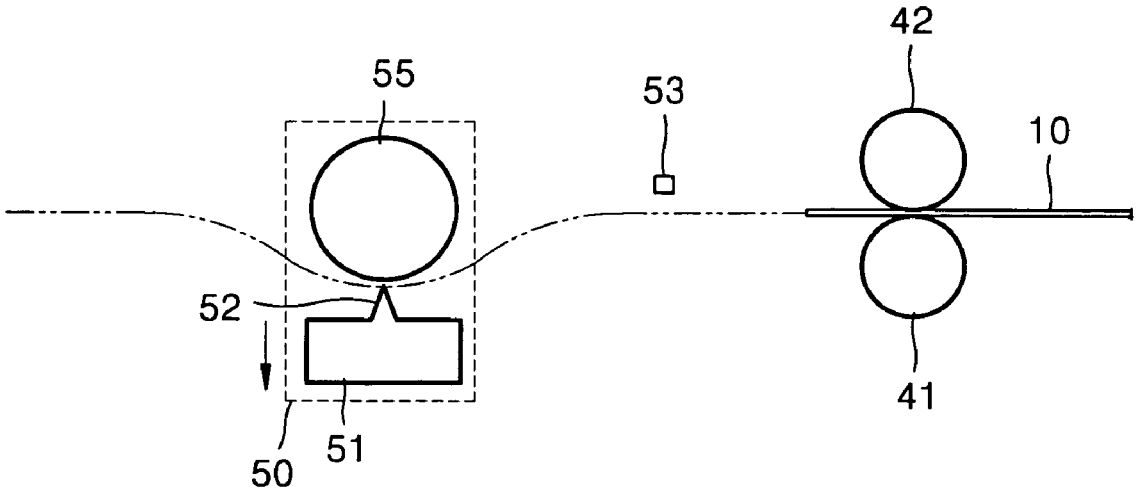

FIG. 7 is a flow chart of a printing method of the thermal printer according to an embodiment of the present invention, and FIGS. 8A and 8B are diagrams for explaining a printing method of the thermal printer according to an embodiment of the present invention.

When a print instruction is input to the control unit 80 from a computer connected to the printer, one sheet of the thermal recording paper 10 is picked up from the paper storage unit 70 by the pick up roller 72 and is entered into the first path (S101).

The thermal recording paper 10 that entered into the first path is moved to the feeding roller 41 by the paper guide 65, and the feeding roller 41 back-feeds the thermal recording paper 10 to the second path in the direction of arrow B (S102). Here, the TPH 51 is raised so that the thermal recording paper 10 may easily pass the TPH 51. During the back feeding process, when an front-end of the thermal recording paper 10 is detected by the optical sensor 53 as shown in FIG. 8A, the thermal recording paper 10 is fed backward in the direction of Arrow B to the initial printing position of the first surface by detecting the pulse signal input from the second encoder sensor 48 to measure the distance fed backward.

Next, the printing on the first surface is performed by closely adhering the TPH 51 to the thermal recording sheet 10 and moving the thermal recording sheet 10 in the printing direction shown by Arrow F (S103). As the first surface is printed, the feeding distance is measures by using the first encoder sensor.

Figure 9:
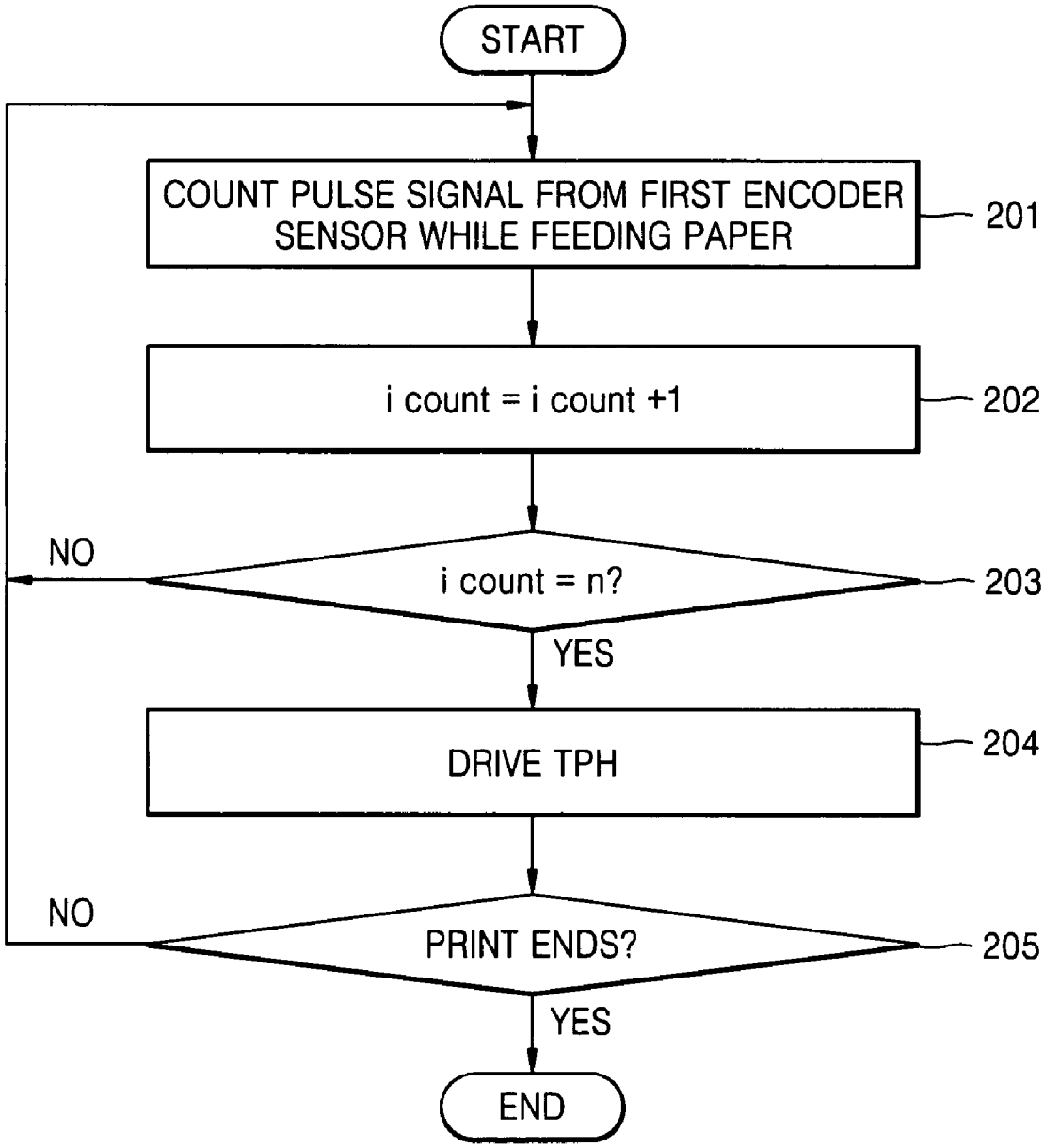
FIG. 9 is a flow chart for explaining the step S103 of FIG. 7 in more detail according to an embodiment of the present invention.

FIG. 9 is a flow chart illustrating in more detail step S103 according to an embodiment of the present invention shown in FIG. 7. Step S103 includes steps S201 to S205.

First, the feeding roller 41 is driven and the thermal recording paper 10 is fed to the print path (S201). Here, the pulse signals from the first encoder sensor 58 are counted and the moving distance of the thermal recording paper 10 is controlled (S201).

The count of the pulse signals is accumulated (S202). It is determined whether the accumulated count (icount) reaches a predetermined number n (S203).

At the step S203, when it is determined that the accumulated count (icount) reaches the predetermined number n, the control unit 80 controls the heat-transfer elements 52 of the TPH 51 corresponding to yellow and magenta image data of the first surface to perform printing on the first surface (S204).

Next, when it is determined that the printing on the first surface is not completed (S205), the step S201 is repeated.

When it is determined that the accumulated count (icount) does not reach the predetermined number n at the step S203, the process returns to the step S201.

When the printing on the first surface is completed, the thermal recording paper 10 is further forward-fed by a predetermined distance such that the thermal recording paper 10 is not in contact with the image forming unit 50 when the image forming unit 50 is rotated. Next, the image forming unit 50 is rotated such that the TPH 51 that was placed on the first surface of the thermal recording paper 10 will be correspondingly placed to the second surface of the thermal recording paper 10 (S104). FIG. 8B is a diagram illustrating a method for printing on the second surface by rotating the TPH 51.

In FIG. 8B, the TPH 51 is lowered slightly, and a gap through which the thermal recording paper 10 may pass between the platen roller 52 and the TPH 51 without resistance is provided. And then, the thermal recording paper 10 is fed backward in the direction of arrow B of FIG. 8A to the second path by the feeding roller 41 for preparing the image formation on the second surface (S105). During the back-feeding process, when the front-end of the thermal recording paper 10 is detected by the optical sensor 53, the thermal recording paper 10 is fed backward to the initial printing position of the second surface while the distance fed backward is measured with the second encoder sensor 48. Since the feeding distance of the thermal recording paper 10 is measured after the detection of the front-end of the thermal recording paper 10, the effects of slip are compensated for by correcting the printing start position based on the measured distance.

Next, the printing on the second surface starts by closely adhering the TPH 51 to the thermal recording sheet 10 and feeding the thermal recording sheet 10 in the printing direction (S106). Here, the pulse signals input from the first encoder sensor 58 are counted to control the feeding distance of the thermal recording paper 10. In addition, when an accumulated count of the pulse signals input from the first encoder sensor 58 reaches at a predetermined number, the control unit 80 controls the heat transfer elements 52 of the TPH 51 corresponding to the cyan image data of the second surface and repeatedly performs printing on the second surface.

When the printing on the second surface is completed, the thermal recording paper 10 is moved to the third path. And then, the movement of the thermal recording paper 10 by the conveying unit 40 is paused and the paper discharge unit 60 discharges the thermal recording paper 10 (S107).

While the above embodiments are illustrated in connection with the thermal printer, the present invention is not limited hereto. In other words, the foregoing explanation may be also applied to a line-feeding printer including a feeding roller feeding a paper, a platen roller facing a printhead, and encoding sensors arranged at the feeding roller and the platen roller.

According to the afore-mentioned thermal printer and printing method, even when slip of a thermal recording paper occurs during a printing process, printing can be performed with alignment of the first and second surfaces because the slip of the thermal recording paper is compensated by using an encoder sensor mounted on a platen roller. Therefore, a high quality image can be obtained.

While the printing method of the present invention have been particularly shown and described with reference to exemplary embodiments thereof, it will be understood by those skilled in the art that various changes in form and details may be made therein. Therefore, the scope of the invention should be defined by the appended claims.

What is claimed is:

1. A thermal printer comprising:

a thermal printhead to apply a predetermined amount of heat to a thermal recording medium to develop a print layer provided on the thermal recording medium;

a feeding roller to feed the thermal recording;

a platen roller to face the thermal printhead to support the thermal recording medium, wherein the thermal recording medium passes between the thermal printhead and the platen roller;

a first encoder sensor to detect a rotation of the platen roller;

a second encoder sensor to detect rotation of the feeding roller;

a counting unit to count first and second pulse signals generated from the first and second encoder sensors, respectively; and a switching unit to select one of the first and second pulse signals as a variable to control feeding of the thermal recording medium.

2. The thermal printer of claim 1, wherein, in a case where an image is printed on the thermal recording medium, the switching unit selects the first pulse signal to use as a control signal to feed the thermal recording medium and a control signal to drive the thermal printhead, and wherein, in a case where an image is not printed on the thermal recording medium, the switching unit selects the second pulse signal to use as the control signal to feed the thermal recording medium.

3. The thermal printer of claim 1, wherein, when an accumulated count of the first pulse signal reaches a predetermined number, the counting unit generates a signal to fire the thermal printhead and outputs the signal to fire the thermal printhead.

4. A thermal printing method with slip compensation, comprising:

a first step of feeding a thermal recording medium into a print path by using a second encoder sensor attached to a feeding roller;

a second step of printing on a first surface of the thermal recording medium while measuring a feeding distance of the thermal recording medium by using a first encoder sensor attached to a platen roller;

a third step of rotating a thermal printhead to face a second surface of the thermal recording medium;

a fourth step of feeding the thermal recording medium into the print path by using the second encoder sensor; and a fifth step of printing on the second surface of the thermal recording medium while measuring the feeding distance of the thermal recording medium by using the first encoder sensor.

5. The thermal printing method of claim 4, wherein, the second and fifth steps comprise an step generating a signal to fire the thermal printhead when an accumulated count of first pulse signals from the first encoder reaches a predetermined number.

6. The thermal printing method of claim 5, wherein, the first and fourth steps comprise the step of controlling a feeding distance of the thermal recording paper while measuring the feeding distance of the thermal recording paper by using second pulse signal from the second encoder sensor.

7. A line-feeding printer comprising:

a printhead to print a predetermined color on a medium;

a feeding roller to feed the medium;

a platen roller to face the printhead to support the, wherein the medium passes between the printhead and the platen roller;

a first encoder sensor to detect a rotation of the platen roller;

a second encoder sensor to detect a rotation of the feeding roller;

a counting unit to count first and second pulse signals generated from the first and second encoder sensors, respectively; and a switching unit to select one of the first and second pulse signals as a variable to control feeding of the medium.

8. The line-feeding printer of claim 7, wherein, in a case where an image is printed on the medium, the switching unit selects the first pulse signal to use as a control signal to feed the medium and a control signal to drive the printhead, and wherein, in a case where an image is not imprinted on the medium, the switching unit selects the second pulse signal to use as the control signal to feed the medium.

9. The thermal printer of claim 7, wherein the counting unit generates a signal to fire the printhead when an accumulated count of the first pulse signal reaches a predetermined number and outputs the signal to fire the printhead.

10. A line-feeding printing method comprising:

a first step of picking up a print medium and feeding the print medium into a print path; and a second step of printing on a first surface of the print medium while measuring a feeding distance of the print medium in the print path by using a first encoder sensor attached to a platen roller a third step of rotating a printhead to face a second surface of the print medium;

a fourth step of feeding the print medium into the print path; and a fifth step of printing the second surface of the print medium while measuring the feeding distance of the print medium by using the first encoder senser.

11. The line-feeding printing method of claim 10, wherein the second and fifth steps comprise the step of generating a signal to fire the printhead when an accumulated count of a first pulse signal from the first encoder sensor reaches a predetermined number and outputting the signal to fire the printhead.

12. The line-feeding printing method of claim 11, wherein, the first and fourth steps comprise the step of controlling a feeding distance of the print medium while measuring the feeding distance of the medium by using a second encoder sensor which is attached to the feeding roller.

* * * * *